US006755712B2

(12) United States Patent
Morris

(10) Patent No.: US 6,755,712 B2
(45) Date of Patent: Jun. 29, 2004

(54) DOLL HAVING SELF-CONTAINED STORAGE COMPARTMENT FOR ACCESSORIES USED THEREWITH

(76) Inventor: Michele M. Morris, 7711 N. Camino de Maximillian, Tucson, AZ (US) 85704

( * ) Notice: Subject to any disclaimer, the term of this patent is extended or adjusted under 35 U.S.C. 154(b) by 0 days.

(21) Appl. No.: 09/837,791

(22) Filed: Apr. 17, 2001

(65) Prior Publication Data

US 2001/0046828 A1 Nov. 29, 2001

Related U.S. Application Data

(60) Provisional application No. 60/197,645, filed on Apr. 17, 2000.

(51) Int. Cl.[7] ..... A63H 3/00

(52) U.S. Cl. ..... 446/98; 446/369; 446/73; 446/268

(58) Field of Search ..... 446/369, 74, 73, 446/72, 98, 97, 268

(56) References Cited

U.S. PATENT DOCUMENTS 2,591,379 A * 4/1952 Schradermeier ..... 150/113
4,543,669 A * 10/1985 Katz ..... 446/369
4,917,607 A * 4/1990 Van Hoose ..... 446/369
4,968,279 A * 11/1990 Smith ..... 446/369
5,092,778 A * 3/1992 Shaver et al. ..... 446/369
5,118,318 A * 6/1992 Lorizio ..... 446/72
5,178,573 A * 1/1993 Smith ..... 446/73
5,328,400 A * 7/1994 Bass ..... 446/98
5,374,192 A * 12/1994 Marble et al. ..... 446/72
5,433,643 A * 7/1995 Pratt ..... 446/73
5,597,339 A * 1/1997 Spector ..... 446/369
5,746,639 A * 5/1998 Bloom et al. ..... 446/98
5,803,787 A * 9/1998 Lulchyski ..... 446/268
6,227,930 B1 * 5/2001 Norman et al. ..... 446/268
6,273,780 B1 * 8/2001 Gardner ..... 446/268

* cited by examiner

*Primary Examiner*—Derris H. Banks
*Assistant Examiner*—Urszula M Cegielnik
(74) *Attorney, Agent, or Firm*—Robert Halper

(57) ABSTRACT

A doll is described which is soft and pliable for safe use as a toy by children which provides inter alia a closeable compartment within the body of the doll for the storage of accessories and clothing associated with the doll.

9 Claims, 3 Drawing Sheets

DOLL HAVING SELF-CONTAINED STORAGE COMPARTMENT FOR ACCESSORIES USED THEREWITH

RELATED APPLICATIONS

This application is based upon my provisional application No. 60/197,645 filed Apr. 17, 2000 and entitled "Closet Doll".

TECHNICAL FIELD

The present invention relates to children's toys and more particularly to dolls and stuffed animals which have removable clothing and accessories and which contain a storage space for storing such accessories and clothing when not in use.

BACKGROUND OF THE INVENTION

Dolls have been popular toys for children for many years. Dolls which have removable accessories and clothing have also been popular. Many times such a doll has a number of sets of accessories and clothing available. During play a child can dress such a doll in one set of accessories and clothing, then remove the first set and replace it with a second set to give the doll a new look. One common problem with dolls which have removable accessories and clothing is preventing the loss of the various accessories and articles of doll clothing. Trunks and chests of drawers have been provided in which to store doll accessories and clothing. The net effect has always been the same. Once the accessories and articles of clothing are separated from the doll, they are frequently misplaced or permanently lost.

The present invention provides a simple solution to the problem of missing accessories and articles of doll clothing. The accessories and clothing are simply stored inside the body cavity of the stuffed doll. A securable opening in the back of the doll allows accessories and clothing to be stored inside the doll until they are needed. Since the doll accessories and clothing are always contained within the doll itself when they are not in use, it is less likely that they will be misplaced or lost. As a further benefit of the present invention, a child does not have to gather up accessories and clothing to match the doll when it is time to play. The accessories and clothing are already present inside the doll. If a child wants to take the doll away from his or her room or the family residence, the doll's accessories and clothing are always available for play at the new location. When it is time for the child to return home, he or she merely returns all of the accessories and articles of clothing not being worn by the doll to the storage compartment inside the doll for the trip home. The present invention is also the perfect toy for an extended trip on public transportation. The extra accessories and clothing are safely stored inside the doll until the child decides to dress and undress the doll. The doll of the present invention is not restricted to a human form or shape but can take the form of stuffed animals, cartoon characters or other fanciful figures.

In recent years, there has been an increasing public awareness of the need to make all children's toys safer. In the past, even dolls could become "weapons" if they were molded of a hard material. A child could hurt another child by striking the child with the doll. In some cases, injury could result when a child threw a doll formed or molded of a hard material at another child. The doll of the present invention is manufactured from a soft material such as cloth and filled with a soft stuffing. In the alternative, the doll is molded from a soft and pliable plastic material. In either case, the doll of the present invention is a safe toy for a small child.

Thus, as will appear, the present invention fulfills a long time need for a stuffed doll which provides a simple arrangement for storing the accessories and clothing associated with such a doll to prevent the accessories and clothing from being misplaced or lost. Further, the present invention is a safe toy for a small child.

BRIEF SUMMARY OF THE INVENTION

The present invention describes a method and apparatus for a doll with a built in storage compartment in the back side of said doll having a closeable opening to provide access to doll clothes and accessories, wherein the aforementioned are always maintained in the storage compartment until ready for use thus obviating loss or misplacement of these items.

Accordingly, it is a primary object of the invention to provide a stuffed doll which provides a compartment for the storage of the doll's accessories and clothing. It is a further object of the invention to provide a doll which is safe for small children.

These and further objects, as shall hereafter appear, are readily fulfilled by the present invention in a remarkably unexpected manner as will be readily discerned from the following detailed description of an exemplary embodiment thereof especially when read in conjunction with the accompanying drawings in which like parts bear like numerals throughout.

DESCRIPTION OF THE PREFERRED EMBODIMENT

Figure 1A:
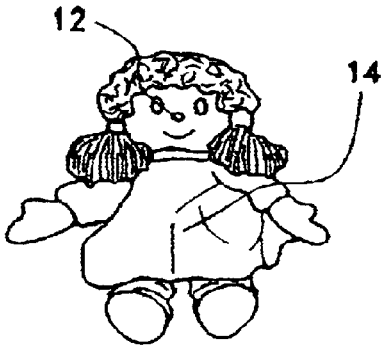
FIG. 1 is a representation of several forms the invention may take.
Figure 1B:
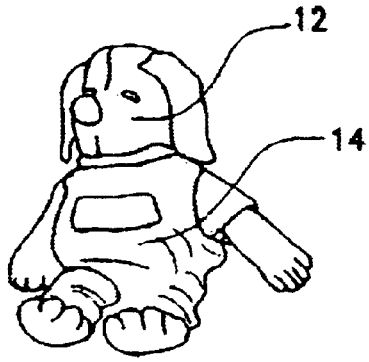
Figure 1C:
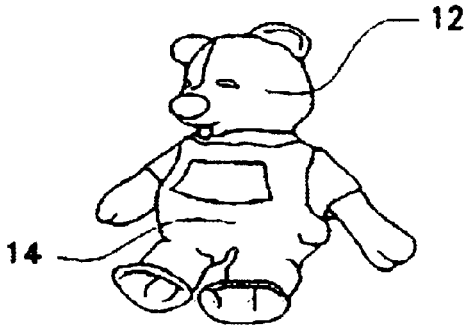
Figure 1D:
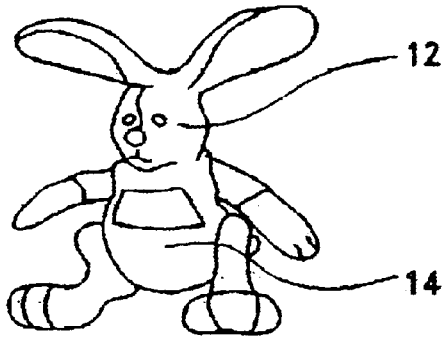
Figure 1E:
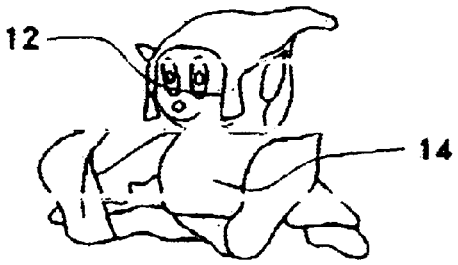
Figure 1F:
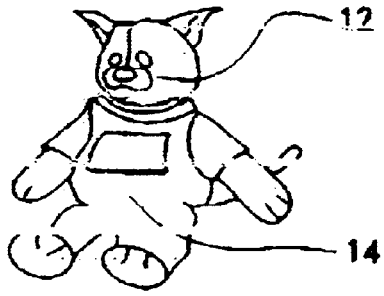
Figure 2A:
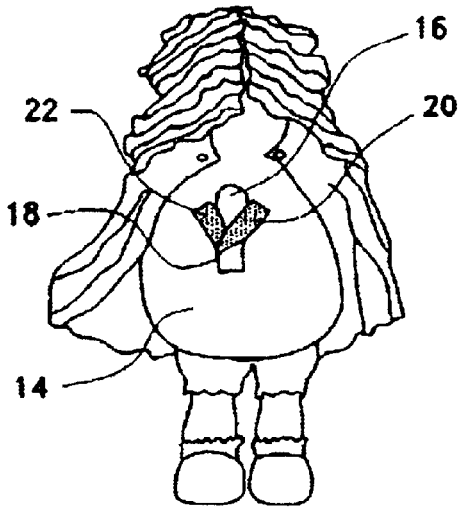
FIG. 2 is a rear view of the invention showing various fastening arrangements for the opening to the storage compartment of the invention.
Figure 2B:
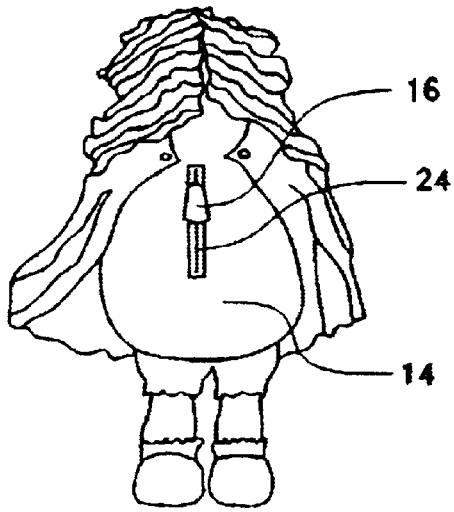
Figure 2C:
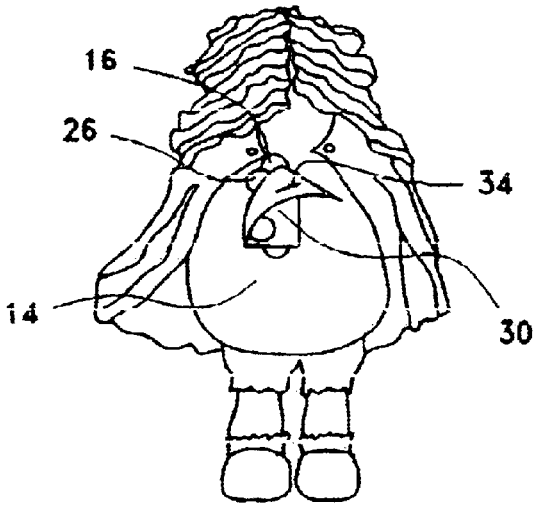
Figure 2D:
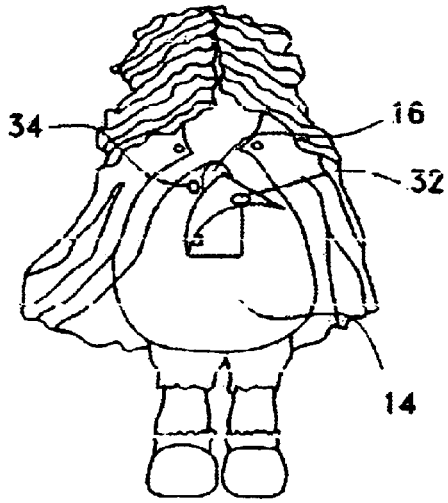

A brief description of an exemplary embodiment of the present invention is set forth herein in sufficient detail to allow a person skilled in the art to understand the operation and fully utilize the invention. The numbered parts of the description refer to the parts identified in the attached figures in which like parts bear like numerals throughout the invention.

As shown in FIG. 1(*a*), the doll of the present invention, identified by the general reference 10, is comprised of a head portion 12 and a body portion 14. FIG. 1(*a*) is a representation of the doll as a human form. FIGS. 1(*b*), 1(*c*), 1(*d*), 1(*e*) and 1(*f*) are further representations of the doll in animal and fanciful forms.

FIG. 2 shows the rear of doll 10 of the present invention where the body 14 of said invention is formed of a pliable material such as cloth or leather. Referring to FIG. 2(*a*), the doll 10 of the present invention contains an opening 16 for ingress and egress to the interior portion of body 14 of said invention. Opening 16 of said doll 10 allows accessories and clothing associated with said doll 10 to be inserted and removed from the interior portion of body 14 of said doll 10. Said opening 16 may be closed using VELCRO® tape 18 by pressing face 20 of said Velcro® tape 18 against second face 22 of said Velcro® tape 18. In a similar manner, and referring to FIG. 2(*b*), opening 16 may be closed using zipper 24 shown in a partially closed position. Referring to FIG. 2(*c*), one or more buttons 26 may be inserted into one or more corresponding slots 28 in cover 30 to dose said opening 16. Cover 30 is fabricated from a pliable material similar to the material used to fabricate body 14 of said doll 10. Referring to FIG. 2(*d*), opening 16 may be closed by engaging outer snap portion 32 in inner snap portion 34.

Figure 3A:
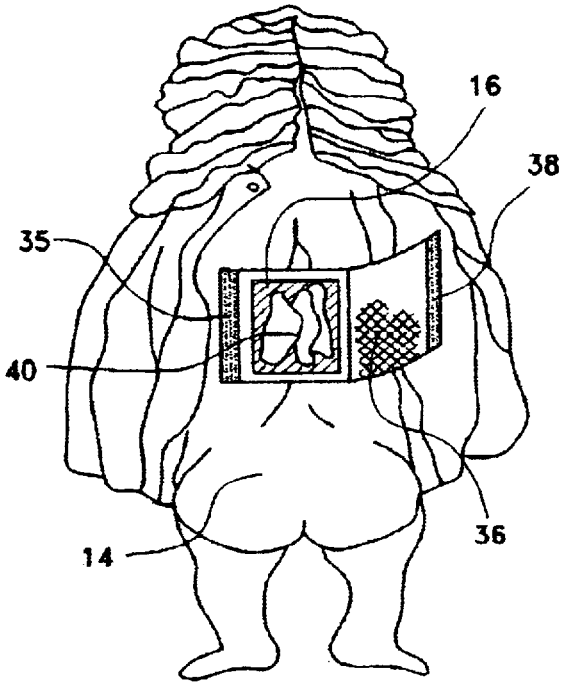
FIG. 3 is a rear view of the invention showing two door arrangements as a closure to the storage compartment of the invention.
Figure 3B:
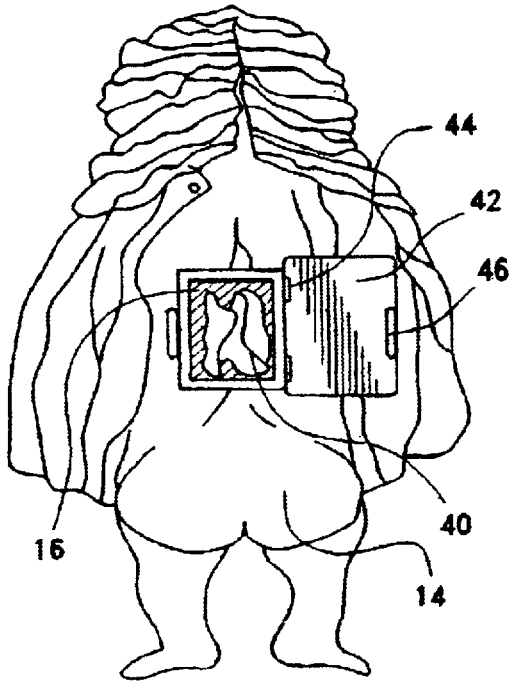

FIG. 3, shows a rear view of doll 10 of said invention where the body 14 of said doll 10 is molded from a pliable material such as a soft plastic. Referring to FIG. 3(*a*), a door 34 fabricated of a pliable material such as cloth or leather and attached to said body 14 may be used to cover opening 16 of said doll 10. A latching device 38 (in this case VELCRO® tape) is used to secure said door 36 in a closed position. In a similar manner, any of the various latching methods shown in FIG. 2 could also be used to secure said door 36 in a closed position. Again referring to FIG. 3, clothing and accessories 40 are shown inside body 14 of said doll 10. Referring to FIG. 3(*b*), a door 42 attached to body 14 of said doll 10 using one or more hinges 44 is used to cover said opening 16. Said door 42 is secured in a closed position by engaging outer latch portion 46 with inner latch portion 48.

Figure 4:
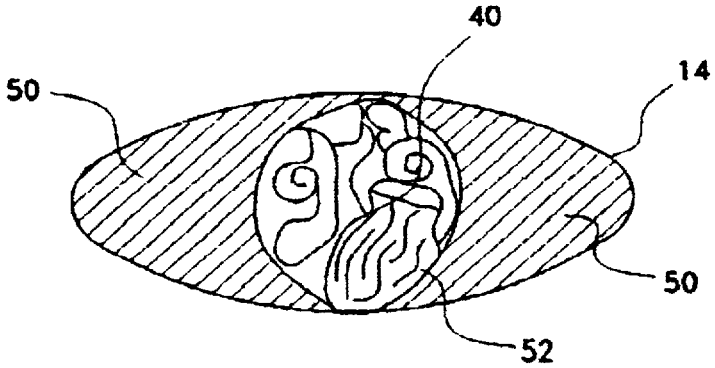
FIG. 4 is a cross-sectional view of the invention showing the storage compartment of the invention with doll accessories and clothing located within the storage compartment.

Referring to FIG. 4, the body 14 of doll 10 of said invention is partially filled with soft stuffing material 50. A storage compartment 52 is created in the middle of said body 14 and the accessories and clothing of said doll 10 serve as the stuffing material in this portion of said body 14.

From the forgoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A doll consisting of a head portion and a body portion, said head portion being integrally formed with said body portion, said body portion being formed of soft pliable material having a front, a rear, a left side and a right side all below said head portion, a storage compartment created in a middle of said body portion, said storage compartment being filled solely with soft pliant material of accessories and clothing of said doll, located at said rear and having a closeable opening, opened to permit ingress of said doll clothes and accessories, and closed to prevent inadvertent egress of said doll clothes and accessories therefrom, and a fastener to secure said opening in a closed position.

2. A doll according to claim 1 in which the form of said doll is selected from the group consisting of a human likeness, an animal likeness and a fanciful likeness.

3. A doll according to claim 1 in which said soft pliable material is selected from the group consisting of soft pliable forms of fabric, plastic and leather.

4. A doll according to claim 1 in which said fastener is selected from the group consisting of a hook and loop fastener, a zipper buttons and snaps.

5. A doll according to claim 2 in which said soft pliable material is selected from the group consisting of fabric, plastic and leather.

6. A doll according to claim 2 in which said fastener is selected from the group consisting of a hook and loop fastener, a zipper, buttons and snaps.

7. A doll according to claim 3 in which said fastener is selected from the group consisting of a hook and loop fastener, a zipper, buttons and snaps.

8. A doll according to claim 1 wherein said closeable opening is a hinged door made of soft plastic and said fastener comprises a latch having an outer latch portion secured to said door and an inner latch portion secured to said body.

9. The process of preventing loss and misplacing of doll clothes and accessories by providing a stuffed doll with a built in storage area located in a rear of a body portion of said doll, forming said body portion of an exterior skin filled with soft stuffing, said storage area being solely for a soft stuffing of doll clothes and accessories maintaining said clothes and accessories in said storage area until needed, said storage area having a closeable opening and cover, covering and fastening said cover to prevent inadvertent egress of said clothes and accessoriess, and unfastening said cover to permit ingress of said clothes and accessories.

* * * * *